US006260329B1

(12) United States Patent
Mills

(10) Patent No.: US 6,260,329 B1
(45) Date of Patent: Jul. 17, 2001

(54) LIGHTWEIGHT BUILDING PANEL

(76) Inventor: Brent P. Mills, 151 E. 100 N., Malad, ID (US) 83252

( * ) Notice: Subject to any disclaimer, the term of this patent is extended or adjusted under 35 U.S.C. 154(b) by 0 days.

(21) Appl. No.: 09/326,713

(22) Filed: Jun. 7, 1999

(51) Int. Cl.[7] ..... E04C 2/34

(52) U.S. Cl. ..... 52/794.1; 52/309.4; 52/309.7; 52/584

(58) Field of Search ..... 52/125.2, 125.3, 52/125.4, 309.4, 309.7, 309.15, 309.16, 481.1, 794.1

(56) References Cited

U.S. PATENT DOCUMENTS

| | | | | |
|---|---|---|---|---|
| 984,491 | * | 2/1911 | Richmond . | |
| 2,877,508 | * | 3/1959 | Ewart . | |
| 3,305,991 | * | 2/1967 | Weisman | 52/309 |
| 3,394,523 | * | 7/1968 | Sackett | 52/584 |
| 3,495,417 | * | 2/1970 | Ratiff | 52/168 |
| 3,604,174 | | 9/1971 | Nelson, Jr. . | |
| 3,605,353 | | 9/1971 | Marcott . | |
| 3,845,593 | * | 11/1974 | Zen | 52/144 |
| 4,090,336 | * | 5/1978 | Carroll | 52/309 |
| 4,185,437 | | 1/1980 | Robinson . | |
| 4,222,785 | | 9/1980 | Henderson . | |
| 4,372,092 | | 2/1983 | Lopez . | |
| 4,518,431 | | 5/1985 | Duvier, Jr. . | |
| 4,649,682 | | 3/1987 | Barett, Jr. . | |
| 5,248,122 | | 9/1993 | Graham . | |
| 5,522,194 | * | 6/1996 | Graulich | 52/309.4 |
| 5,661,930 | * | 9/1997 | Porter | 52/64 |
| 5,772,751 | | 6/1998 | Nisnevich et al. . | |
| 5,799,462 | * | 9/1998 | McKinney | 52/742.13 |
| 5,860,268 | | 1/1999 | McWilliams . | |

* cited by examiner

*Primary Examiner*—Carl D. Friedman
*Assistant Examiner*—Steve Varner
(74) *Attorney, Agent, or Firm*—Richard C. Litman

(57) ABSTRACT

A lightweight, low cost, insulating construction panel having a rectangular channel-iron frame, an outside face of lightweight corrugated metal, a main filler comprising a perlite and pumice binder sandwiching an insulating foam core. The construction panel has a plurality of vertical channel irons spaced in succession and forming a plane common to an inside face of the panel. Two weld wire screens are disposed against each of the inner surface and the outer surface of the foam core, and fastened together through individual weld wires extending horizontally through the foam core. The outside face may have a decorative, cementitious material. Each box frame has attachment means along each of four perimeter sides capable of mechanical attachment to a foundation and to at least three other panels so as to become load-bearing. The construction panel is strong, flexible, termite and fire-proof, and hurricane and earthquake resistant.

10 Claims, 6 Drawing Sheets

LIGHTWEIGHT BUILDING PANEL

BACKGROUND OF THE INVENTION

1. Field of the Invention

The present invention relates to prefabricated construction panels, and more particularly, to construction panels having a load-bearing structure.

2. Description of the Related Art

Load-bearing prefabricated wall panels are well-known in the art. However, to date, no one has combined the various structural features and material compositions disclosed in the present invention so as to address and overcome problems associated with all of the following: insulating qualities; weight; strength; flexibility; termites and fire; earth quake activity; modularity; connectibility; and mailability of the concrete panel.

For example, U.S. Pat. No. 4,649,682 issued in March 1987 to Barrett, Jr. teaches a prefabricated building panel. The Barrett invention has channel-shaped structural support members that are aligned generally normal to the plane defining the wall length, that are not flush with the panel surface. Thus the structural support members of the Barrett invention serve to conduct heat through the panel, which is not useful, particularly for an insulated panel. In addition, the Barrett invention does not have a pumice/perlite concrete mix, such mix having superior qualities in the specified proportions. Finally, although Barrett does disclose the use of rebar, Barrett does not disclose two parallel layers of weld-wire mesh tied together through the insulated panel center so as to improve shear strength without any substantial loss in insulating qualities. Thus, Barrett, Jr. does not suggest the present invention as claimed.

U.S. Pat. No. 3,604,174 issued in September 1971 to Nelson, Jr. discloses another prefabricated wall panel having a structural frame that doubles as a form but having the same shortcomings as the Barrett device. Therefore, Nelson does not suggest the present invention as claimed.

U.S. Pat. No. 4,372,092 issued in February 1983 to Lopez discloses a prefabricated wall panel having a mix of pumice and perlite but without any indication as to the pumice/perlite weight ratio, and without any of the frame or structural features of the present invention. Lopez thus does not suggest the present invention as claimed.

U.S. Pat. No. 4,222,785 issued in September 1980 to Henderson discloses a construction material, i.e. construction blocks, comprising two or four parts ash to four parts perlite, by volume, which is a significantly different from one part perlite to four parts pumice, by weight. Moreover, Henderson does not specify any structural or reinforcing components of the construction material, nor does Henderson disclose or suggest the use of this material for a structural wall panel. Accordingly, Henderson does not suggest the present invention as claimed.

U.S. Pat. No. 4,185,437 issued January 1980 to Robinson discloses a wall panel having a structural frame and structural support members disposed in the same disadvantageous manner as in the Barrett and the Nelson assemblies so as to conduct heat and to maintain interruptions in the insulation layer. In addition, the Robinson assembly makes no mention of pumice or perlite. Robinson, therefore, does not suggest the present invention as claimed.

U.S. Pat. No. 5,860,268 issued in January 1999 to McWilliams teaches the use of pumice-type aggregates in a non-load bearing fire door, but having no perlite, and having few of the structural components of the present invention. McWilliams therefore does not suggest the present invention as claimed.

U.S. Pat. No. 5,248,122 issued in September 1993 to Graham is a concrete wall panel having a steel-reinforced grid. Graham does not suggest the present invention as claimed.

U.S. Pat. No. 4,518,431 issued in May 1985 to Duvier, Jr. is a perlite-type block. Duvier, Jr. does not suggest the present invention as claimed.

U.S. Pat. No. 3,394,523 issued in August 1965 to W. J. Sackett, Sr. teaches tilt-up, reinforced, linkable wall and roof panels. Sackett, Sr. does not suggest the present invention as claimed.

U.S. Pat. No. 3,605,353 issued in September 1971 to G. L. Marcott teaches light-weight construction panels. Marcott does not suggest the present invention as claimed.

U.S. Pat. No. 5,772,751 issued in June 1998 to Nisnevich et al. teaches a composition for light-weight concrete. Nisnevich et al. does not suggest the present invention as claimed.

None of the above inventions and patents, taken either singularly or in combination, is seen to describe the instant invention as claimed. Thus a lightweight building panel solving the aforementioned problems is desired.

SUMMARY OF THE INVENTION

The invention is a light-weight wall panel assembly comprising a volcanic silicate binder poured into a metal frame that can be lifted in place and welded to another panel frame. The assembly is useful in building homes, shops, cabins, industrial buildings, horse barns, storage sheds, etc. The panels have many desirable qualities such as being fire proof, and sound and vibration resistant. The panels are easy to transport and, due to the steel frame, unlikely to be damaged or chipped during transport. The panels are also termite proof and highly flexible.

A builder can vary the strength of the mixture of the binder material, comprising a specified mix ratio of fine perlite and pumice aggregate, which are volcanic silicates having high strength and an elasticity similar to steel. In the U.S., prefabricated wall panels are typically made from prestressed concrete having a cement and sand mix. The present panel is less than 25% of the weight of regular concrete panels, and as the perlite/pumice slurry dehydrates, it becomes even lighter and stronger. Due to the perlite/pumice mix ratio, the panel is also insulating and nailable. Homes made with these modular panels can be made for ⅓ the cost of a lumber home, and they will last much longer.

A sheet of corrugated metal may be used as the form floor, and to double as a structural member along an outside face so as to provide additional tensile and compressive strength in the finished product.

The panels have a foam core sandwiched by wire mesh screens. The wire screens are preferably machine welded, and connected by weld wire through the foam core. The panel has structural rebar extending vertically and horizontally along at least one side of the foam core.

The channel-iron frame is used as both a form and as a structural member which, together with the volcanic silicate binder mix, provides a light-weight concrete panel that is insulated, and can withstand tensile forces as well as earthquake shock. The panel is modular in the sense that the frame has means for attachment to other panels, and can be welded to foundation weld plates, conveniently making the building assembly tornado and hurricane resistant.

The panel also has upright structural channels that are preferably 3 feet apart, welded to the channel iron frame and disposed in parallel succession along the inside face of the wall, i.e., facing indoors. The structural channels are flush with the inside face of the panel. This is unique in the sense that the prior art has structural channels, but they are aligned generally normal to the plane defining the wall length, and are internally disposed, and not flush with the panel face. Thus the structural channels of the prior art ultimately serve to conduct heat through the panel, which is not useful, particularly for an insulated panel.

Accordingly, it is a principal object of the invention to provide a lightweight modular construction panel that is relatively low-cost, and that will serve as a structural member.

It is another object of the invention to provide a construction panel that is extremely durable.

It is a further object of the invention to provide a construction panel that is termite proof and fire resistant.

Still another object of the invention is to provide a construction panel that combines a channel-iron box frame with a volcanic silicate binder so as to be strong, flexible, and hurricane resistant.

A further object of the invention to provide a construction panel having excellent insulating characteristics so as to minimize sound and vibrations, such as from an earthquake.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIG. 1 (B) is an eyebolt used as a connector to hoist the panel.

FIG. 2 (B) is a perspective view with a partial cut away showing the outside face of a completed wall panel.

Similar reference characters denote corresponding features consistently throughout the attached drawings.

DETAILED DESCRIPTION OF THE PREFERRED EMBODIMENTS

Figures 1A, 1B:
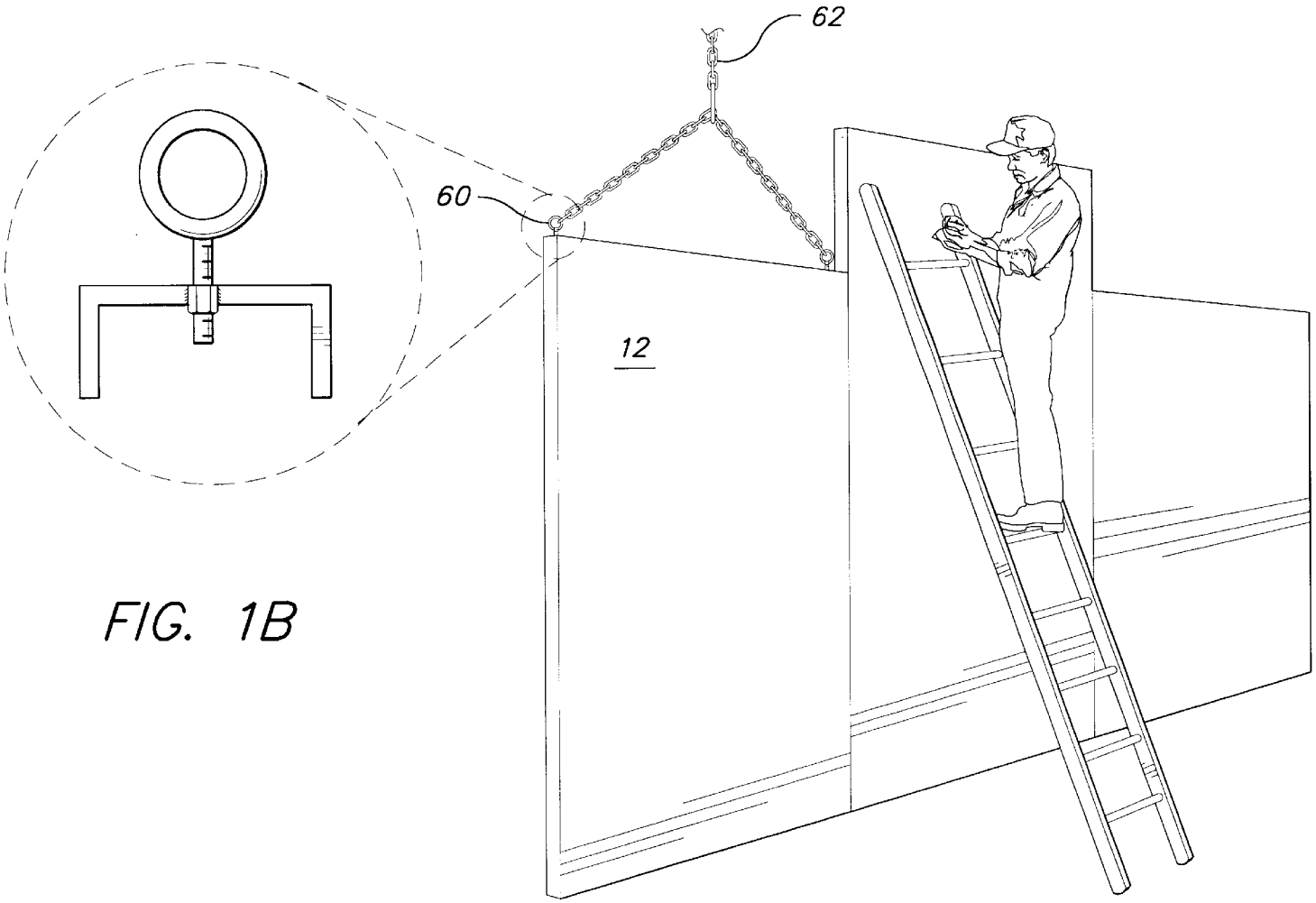
FIG. 1 (A) is an environmental, perspective view of a lightweight building panel being lifted and installed so as to form a wall assembly according to the present invention.
Figure 3:
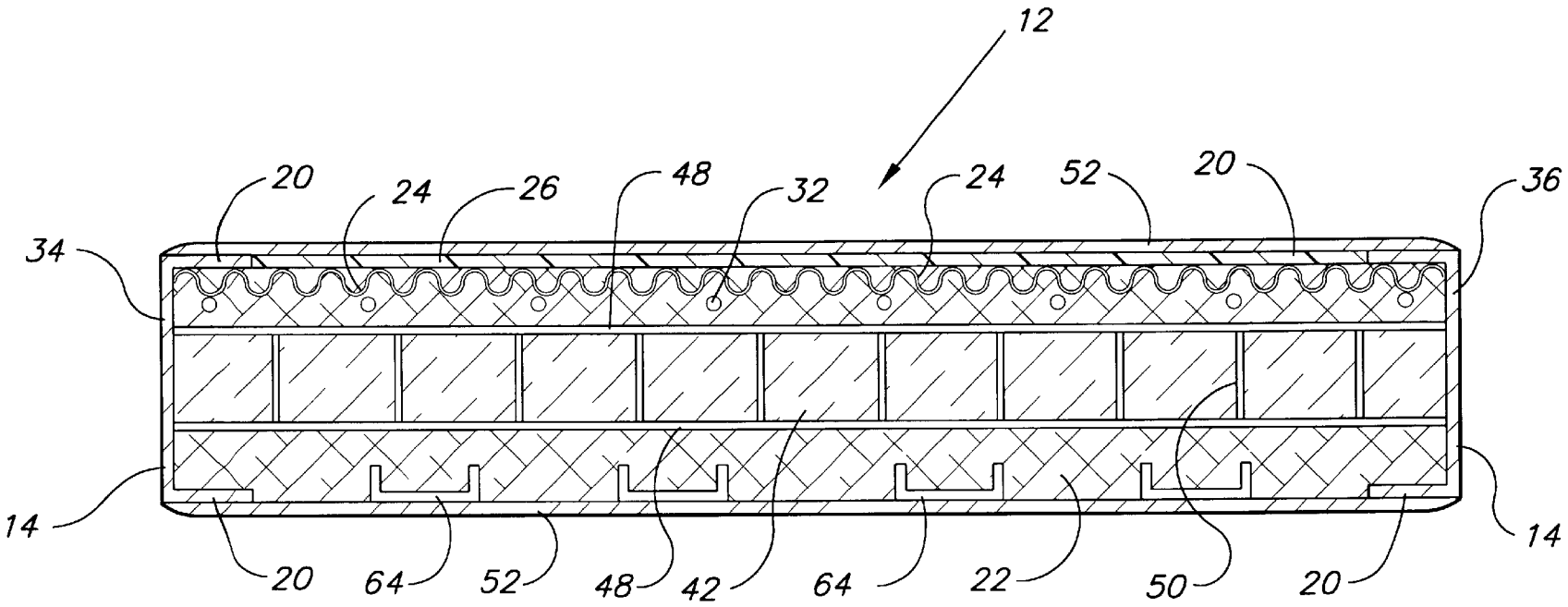
FIG. 3 is a horizontal section view on the line 3—3 of FIG. 2A.
Figure 4:
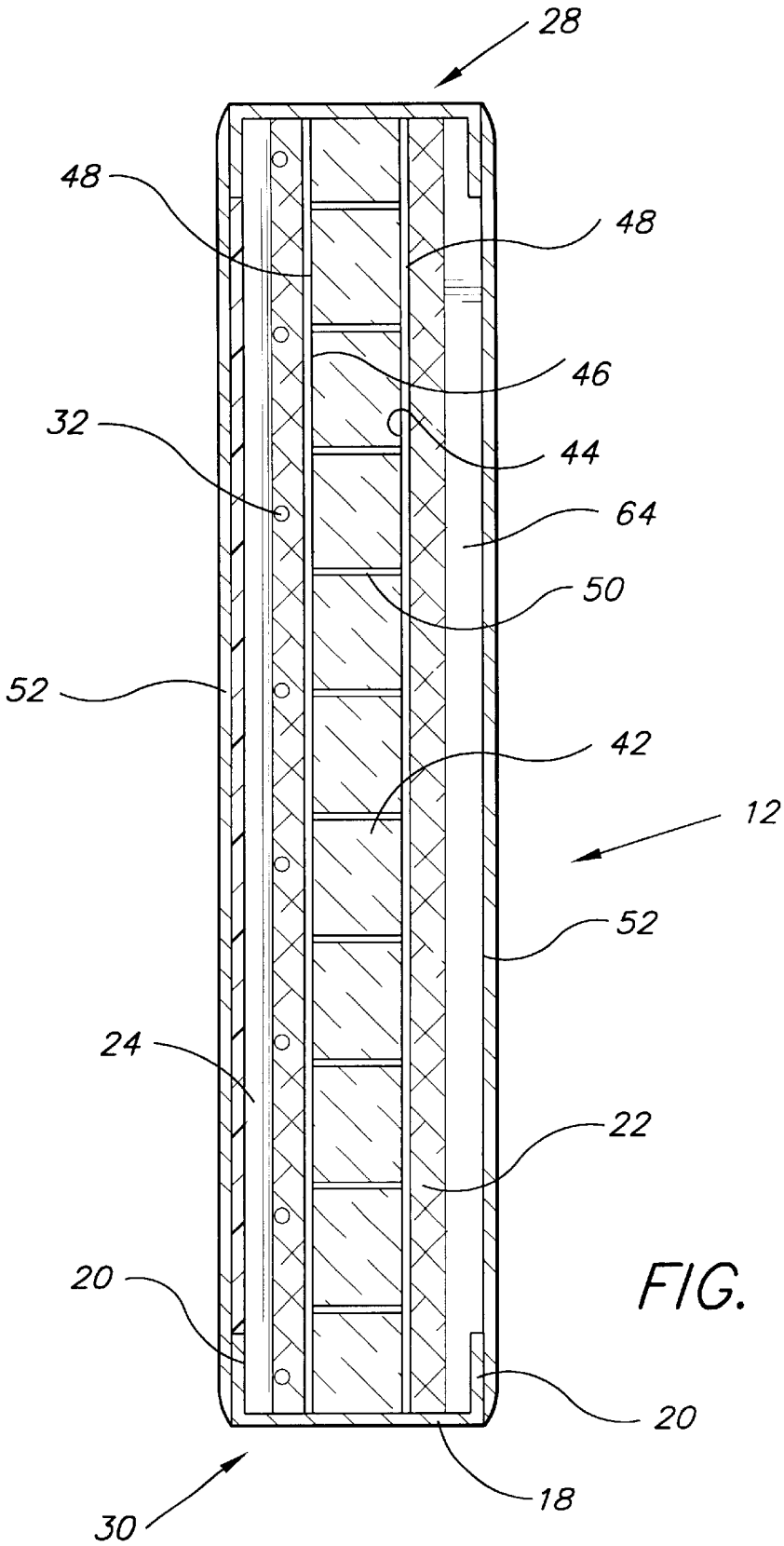
FIG. 4 is a vertical section view on the line 4—4 of FIG. 2A.

The present invention is a pre-fabricated building construction panel 12 as shown in FIG. 1. Shown in FIGS. 3 and 4, panel 12 comprises four channel-iron members 14 welded at their ends 16 to form a rectangular channel-iron frame 18. The channel-iron frame 18 is between 3" to 8" in width (wall width), and has a thickness of between ⅛" to ⅜". The preferred frame 18 is 4" wide by ⅛" thick, with a channel return leg, or flange 20, having a thickness of ¼". The combination of the channel iron frame 18, which is used as both a form and as a structural member, together with a volcanic silicate main body filler 22, provides a light weight concrete panel that can withstand tensile forces as well as earthquake shock.

In the preferred embodiment, a rectangular piece of corrugated light-weight sheet metal 24 is welded to the inside flange 20 of frame 18 so as to define a form floor that doubles as an outside surface 26 of panel 12. The corrugated sheet metal 24 contributes significantly to the strength of panel 12 as against any crushing force due to vertical loads.

A series of vertically oriented, parallel rods 32 (or rebar) extend between the channel-iron top member 28 and bottom member 30. A series of horizontally oriented, parallel rods 32 extend transversely between the channel-iron left member 34 and right member 36. Rods 32 are preferably welded to the vertical and horizontal channel iron members. It will be apparent that rods 32 could constitute pre-stressed rods and/or wires, should they be desired.

Panel 12 has attachment means along the outside surface of each of four perimeter sides of frame 18, so as to be capable of mechanical attachment to a foundation and to at least three other such panels so as to form a load-bearing wall assembly 36. Bottom member 30 is preferably welded to weld plates 38 along the foundation wall 40, conveniently making building assembly 36 tornado and hurricane resistant.

The main body filler 22 of panel 12 is made from a concrete mixture comprising perlite and pumice that is poured preferably, although not necessarily, when the frame is laid horizontally, such that the concrete mixture will be molded within the peripheral frame formed by the channel members. The preferred mixture calls for a fine perlite and pumice aggregate mix, which are volcanic silicates having an elasticity similar to steel, and which are very strong. Perlite is approximately ⅐th as dense as pumice. The preferred mix of fine perlite to pumice has a weight ratio of one part perlite to four parts pumice. This mixture provides the necessary insulating qualities and strength, while at the same time, making the filler nailable and sawable. For other requirements, the proportion of perlite to pumice can vary from a perlite/pumice ratio of 1 to 5 to a perlite/pumice ratio of 1 to 1 depending upon the job requirements. The preferred panel is less than 25% of the weight of a typical concrete (cement/sand/water) wall panel; standard concrete is approximately 150 lbs/cubic foot, whereas the volcanic silicate slurry is 20 lbs to 55 lbs/cubic foot.

The perlite and pumice mixture results in a density-controlled aggregate having qualities such as being light-weight, and having a remarkable ability to absorb seismic shock. These qualities, when combined with the strength and flexibility of a channel-iron frame, together with other disclosed structural components, provides an exceptional wall panel.

Main body filler 22 sandwiches an insulating foam core 42 having an inner surface 44 opposite an outer surface 46. Foam core 42 is preferably 1" thick, but may range from ½" to 2" thick, and may be any suitable, durable insulation.

In the preferred embodiment, a wire mesh screen 48 is disposed against each of two major surfaces of foam core 42. Screens 48 are fastened together through individual tie wires 50 extending horizontally through foam core 42. Depending on the thickness of foam core 42, screens 48 may come in different sizes. Screens 48 are preferably of 12–14 gauge, machine-welded wire, and have approximately 1½" square openings.

Filler 22 can be poured to fully fill the space between the channel members, or it can be poured to fill only to the level of the inside surfaces of the channel member flanges.

Figures 2A, 2B:
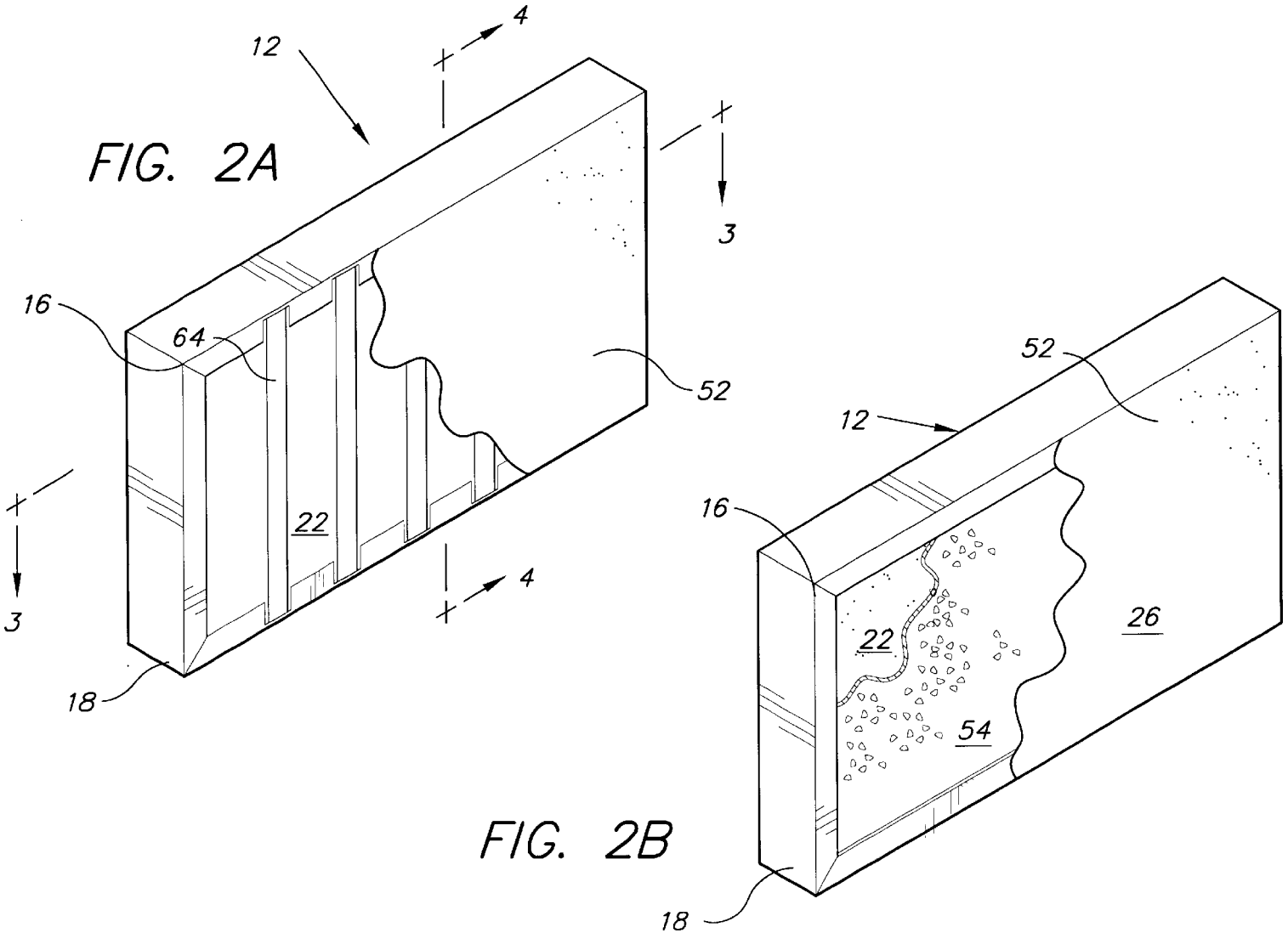
FIG. 2 (A) is a perspective view with a partial cut away showing the inside face of a completed wall panel.

Thereafter, an additional coating 52 of a decorative material may be applied. Decorative material may comprise, for example, paint, cementitious coatings (including decorative rock or other materials), or it can constitute thin panels bonded to the surface of the concrete. The decorative facing can be made flush with the exterior surfaces of the channel members or can be projected outwardly therefrom. As shown in FIG. 2, the facing on panel 12 may be made of rock chips 54 sprayed on to the surface of the perlite/pumice concrete with an adhesive that will hold it in place.

Figure 5:
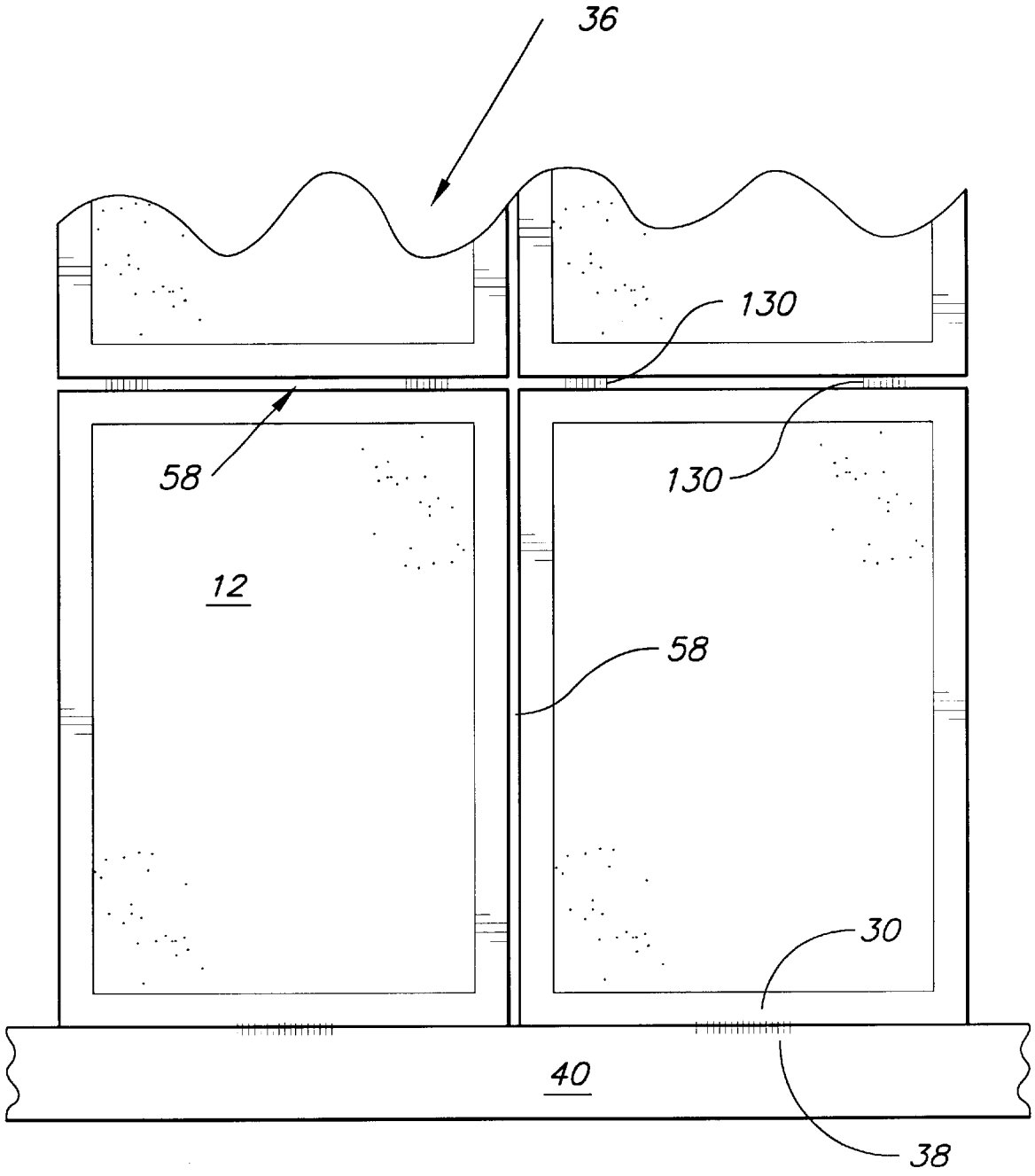
FIG. 5 is an elevation view showing the panels stacked, and spot welded together, and to a foundation weld plate.

Panels 12 can be raised into position on footings or on top of other such panels 12. Attachment means between adjacent panels is preferably a spot-weld 130, as shown in FIG. 5. Panels 12 are similarly welded to metal plates 38 set into the footings 40. A waterproofing mastic 58 can then be injected between the construction panels to insure a complete seal. Because of the weight of the construction panels, even large construction panels, for example those twenty feet square, can be easily handled. The corrugated metal panels, when painted, will provide an aesthetically pleasing exterior wall surface for many commercial buildings and, since the wall panels have sufficient strength, no additional bracing is required. Walls produced with the panels have sufficient strength to easily support a conventional roof.

A bracket or eye bolt 60 may be welded to a top edge of the construction panels, if desired, to facilitate use of a crane 62 or other such equipment in the positioning of panels 12.

Vertically oriented structural channel-irons 64 are spaced preferably every three feet in horizontal succession to form a plane defining the inside face of the construction panel, i.e., the indoor face. Structural channels 64, also termed "support members", are welded to frame 18 and are flush with inside face 66. The orientation of these structural channels is critical because when a major surface of the structural channel 64 is flush with a face of panel 12, channel 64 will not conduct heat through panel 12.

Figure 6:
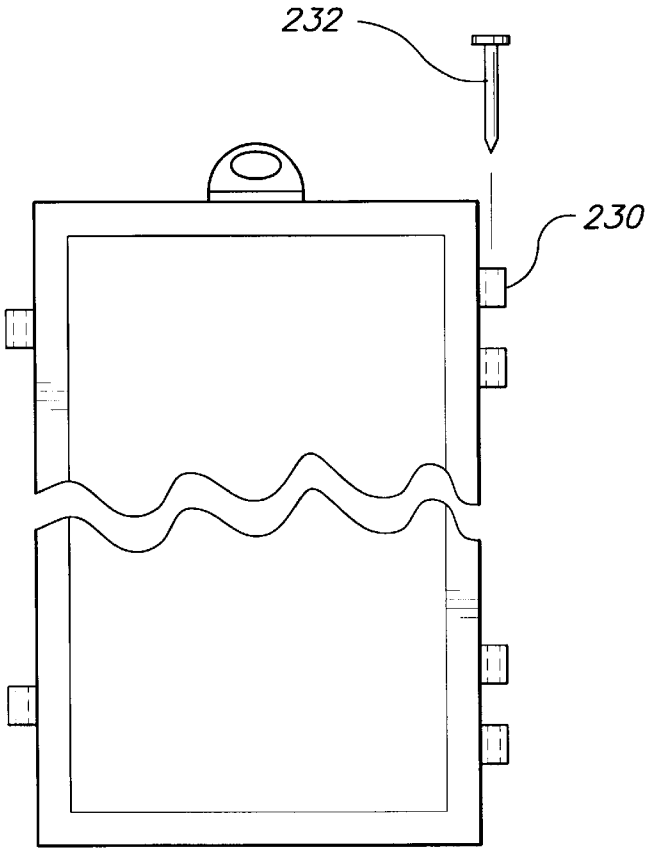
FIG. 6 is a hinge-type connection between panels.

As in the embodiment depicted in FIG. 6, attachment means between panels 12 may alternatively include cooperating hinge barrels 230 welded to the sides of the construction panels such that when panels 12 are positioned in a side-by-side relationship, hinge barrels 230 will be in alignment and a hinge pin 232 can be inserted to lock panels 12 together. This allows for rapid connection of panels 12, particularly when the panels are used for temporary or semi-temporary construction. If desired, foam plastic, or other such material, can be injected into any space remaining between the hingedly interconnected panels.

Figure 7:
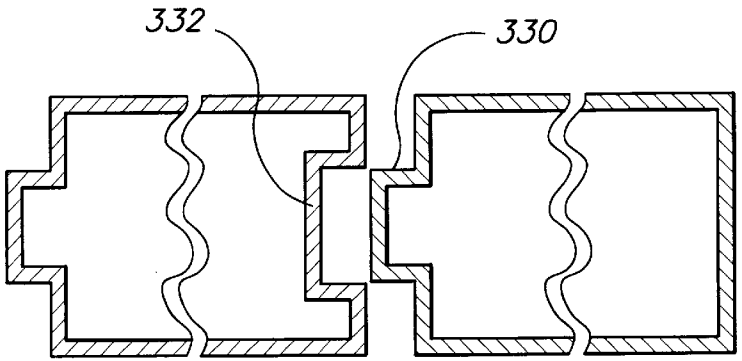
FIG. 7 is a tongue and groove connection between panels.

As shown in a second embodiment of FIG. 7, frame 18 of panel 12 can also be constructed to provide a tongue and groove interlocking connection. In this embodiment, a tongue 330 is formed in the channel member at a left side of each construction panel and in the channel member at the top, while a groove 332 is formed in the channel members at a right side and at the bottom. When the construction panels are arranged in side-by-side arrangement, the tongue of one panel will project into the groove of the other. Similarly, if the panels are stacked vertically, the tongue 330 on top of the lower construction panel will extend into the groove 332 in the bottom of the upper construction panel. The tongue portions of the channel members and the portions of the channel members defining the side walls of the grooves are filled with the perlite/pumice concrete so that when a tongue 320 and a groove 332 interlock, the perlite/pumice concrete acts as insulation across the common joint.

Figure 8:
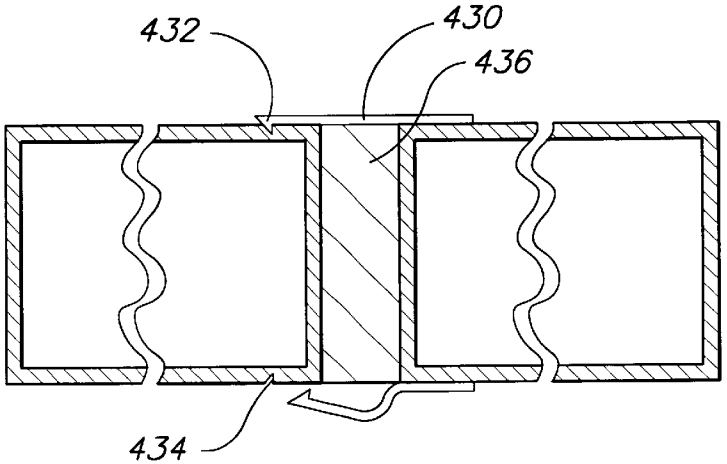
FIG. 8 is a panel connector comprising a locking steel strap.

Other types of connectors can also be used to interconnect the construction panels. For example, in a third embodiment, shown in FIG. 8, the construction panels previously disclosed have flat, spring steel clips 430 welded thereto such that hooks 432 of clips 430 will snap into holes 434 provided for in frame 18 of panels 12. A resilient, insulating pad 436 is preferably positioned between adjacent panels. Pad 436 is compressed slightly as hooks 432 of one panel are inserted into holes 434 of another. While not shown, it will be apparent that clips 430 and matching holes 434 will be provided at the top and bottom of each construction panel, and on both the inside and outside of each panel.

It is to be understood that the present invention is not limited to the embodiments described above, but encompasses any and all embodiments within the scope of the following claims.

I claim:

1. A lightweight building panel, comprising:

a rectangular channel-iron frame, said frame having a horizontal top member, a horizontal bottom member, a vertically-oriented left member, a vertically-oriented right member, each said member having an inside flange, an outside flange, and a perimeter surface, said frame having attachment means along each said perimeter surface, wherein said attachment means is a steel spring clip and corresponding notch for receiving said spring clip and said means capable of connecting said frame to a foundation weld plate and to each of three other frames so as to form a load-bearing wall assembly;

an outside face of lightweight, structural corrugated metal, wherein said corrugated metal doubles as a form floor;

an inside face opposite said outside face;

a main filler comprising a perlite and pumice aggregate mix sandwiching an insulating foam core, said core having an outer surface proximate said outside face of said panel, and an inner surface proximate said inside face of said panel;

a pair of wire mesh screens sandwiching said foam core, said screens fastened together through individual weld wires extending horizontally through said foam core;

a plurality of vertically oriented channel-iron support members spaced in horizontal succession to form a plane defining said inside face of said panel;

a plurality of reinforcing bars extending between and connecting said top member to said bottom member, and a plurality of reinforcing bars extending between and connecting said left member to said right member so as to form a plane between said outer surface and said outside face;

a decorative coating on said inside face and said outside face of said panel;

wherein, said inside flange of said top member and said inside flange of said bottom member are notched so as to receive said support members such that said support members remain flush with said inside face, and wherein said reinforcing bars are welded to said channel-iron frame.

2. The device according to claim 1, wherein said corrugated sheet metal is welded to each said outside flange of said frame.

3. The device according to claim 1, wherein said frame serves as a form.

4. The device according to claim 1, wherein said aggregate mix comprises approximately one part fine perlite to approximately four parts pumice by weight.

5. The device according to claim 1, wherein the proportion by weight of fine perlite to pumice is between 20% and 100%.

6. The construction panel of claim 1, wherein said outside face is coated with a substance selected from among a group consisting of: a decorative, cementitious material; paint; a thin panel bonded to said filler.

7. The device according to claim 1, wherein said mesh screens are machine welded.

8. The device according to claim 1, wherein said top member has attached thereto at least one eyebolt capable of receiving a hook of a crane arm.

9. The device according to claim 1, wherein said attachment means is a hinge barrel.

10. The device according to claim 1, wherein said attachment means is a tongue and groove type attachment.

* * * * *